US010244871B2

(12) United States Patent
Kuo

(10) Patent No.: US 10,244,871 B2
(45) Date of Patent: Apr. 2, 2019

(54) CUSHION

(71) Applicant: Chun-Fu Kuo, Taichung (TW)

(72) Inventor: Chun-Fu Kuo, Taichung (TW)

( * ) Notice: Subject to any disclaimer, the term of this patent is extended or adjusted under 35 U.S.C. 154(b) by 208 days.

(21) Appl. No.: 15/488,032

(22) Filed: Apr. 14, 2017

(65) Prior Publication Data

US 2018/0295997 A1 Oct. 18, 2018

(51) Int. Cl.
*A47C 7/74* (2006.01)
*A47C 21/04* (2006.01)
*A47C 27/00* (2006.01)

(52) U.S. Cl.
CPC ..... *A47C 7/744* (2013.01); *A47C 21/044* (2013.01); *A47C 27/006* (2013.01)

(58) Field of Classification Search
CPC ..... A47C 7/74
USPC ..... 5/724, 726, 652.1, 652.2
See application file for complete search history.

(56) References Cited

U.S. PATENT DOCUMENTS 6,782,574 B2 * 8/2004 Totton ..... A61G 7/05769 5/710
2007/0283498 A1 * 12/2007 Shelby ..... A47C 27/002 5/706
2010/0122417 A1 * 5/2010 Vrzalik ..... A47C 21/046 5/652.1
2010/0274331 A1 * 10/2010 Williamson ..... A61G 7/05738 607/104

* cited by examiner

*Primary Examiner* — Fredrick C Conley
(74) *Attorney, Agent, or Firm* — Muncy, Geissler, Olds & Lowe, P.C.

(57) ABSTRACT

A cushion is provided, including: a first recoverable layer, having a first flow passageway; a second recoverable layer, having a second flow passageway; a separation layer, located between the first and second recoverable layers, one of two ends of the separation layer having a passage, the first flow passageway, the passage and the second flow passageway forming a circulation flow passageway, the first and second recoverable layers being connected with the separation layer; a outer layer, encompassing and being connected with the first recoverable layer, the second recoverable layer and a side portion of the separation layer.

15 Claims, 4 Drawing Sheets

CUSHION

BACKGROUND OF THE INVENTION

Field of the Invention

The present invention relates to a supporting structure, and more particularly to a cushion.

Description of the Prior Art

Generally, a cushion is for a user to comfortably lie or sit on. In the prior art, a cushion is usually made of a single layer of foam. Although foam is soft and comfortable, after the cushion is used for a long time, air circulation of the cushion weakens and accumulates heat and humidity easily. Therefore, if the user sits on the cushion, s/he may feel uncomfortable, and his/her skin may have bed sores. Even though there are ventilating cushions which are made of stereoscopic mesh fabric on the market, problems like bad air circulation or odor accumulation still cannot be solved.

The present invention has arisen to mitigate and/or obviate the afore-described disadvantages.

SUMMARY OF THE INVENTION

The major object of the present invention is to provide a cushion, and the cushion has a preferable air circulation efficiency so that user comfort is elevated.

To achieve the above and other objects, a cushion is provided, including: a first recoverable layer, having a first flow passageway; a second recoverable layer, having a second flow passageway; a separation layer, located between the first and second recoverable layers, one of two ends of the separation layer having a passage, the first flow passageway, the passage and the second flow passageway forming a circulation flow passageway, the first and second recoverable layers being connected with the separation layer; an outer layer, encompassing and being connected with the first recoverable layer, the second recoverable layer and a side portion of the separation layer.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figures 1, 3:
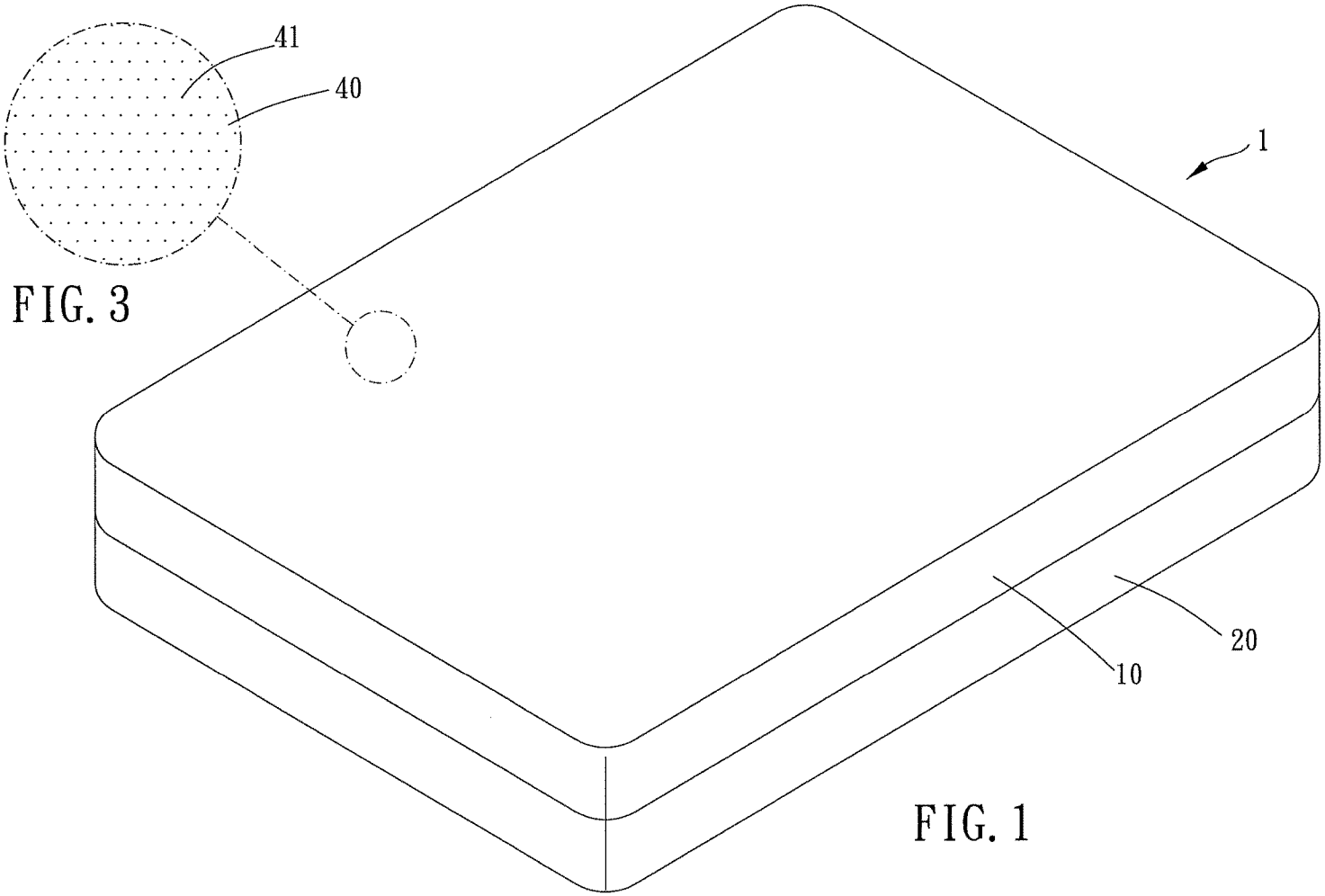
FIG. 1 is a stereogram of a first preferred embodiment of the present invention.
FIG. 3 is an enlarged view of an outer layer of the first preferred embodiment of the present invention.
Figure 2:
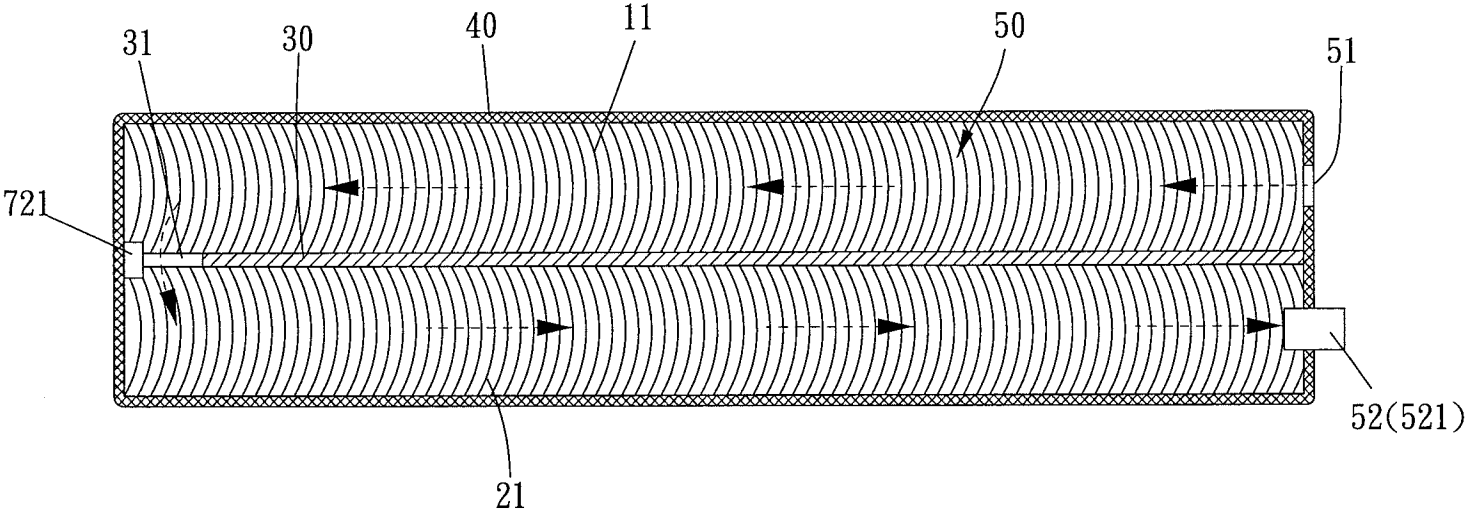
FIG. 2 is a cross-sectional view of the first preferred embodiment of the present invention.

Please refer to FIGS. 1 and 2 for a first preferred embodiment of the present invention, a cushion 1 includes a first recoverable layer 10, a second recoverable layer 20, a separation layer 30 and an outer layer 40. The present invention can be applied to a mattress, a seat cushion and other pads.

The first recoverable layer 10 has a first flow passageway 11; the second recoverable layer 20 has a second flow passageway 21; the separation layer 30 is located between the first and second recoverable layers 10, 20, one of two ends of the separation layer 30 has a passage 31, the first flow passageway 11, the passage 31 and the second flow passageway 21 form a circulation flow passageway 50, and the first and second recoverable layers 10, 20 are connected with the separation layer 30; and the outer layer encompasses and is connected with the first recoverable layer 10, the second recoverable layer 20 and a side portion of the separation layer 30. Therefore, air circulation is more preferable, and heat and humidity do not accumulate easily, so it is more comfortable for a user to sit on the cushion 1 for a period of time.

The first and second recoverable layers 10, 20 and the separation layer 30 may has a plurality layers in different thicknesses, so a thickness and a number of layers of the first and second recoverable layers 10, 20 and the separation layer 30 can be adjusted according to various needs so as to provide different support and buffer effects. In this embodiment, a number of the first recoverable layer 10, a number of the second recoverable layer 20 and a number of the separation layer 30 are respectively one.

The thickness of the first recoverable layer 10 is between 1.00 cm and 20.00 cm; the thickness of the second recoverable layer 20 is between 1.00 cm and 50.00 cm; and in this embodiment, the first and second recoverable layers 10, 20 are arranged parallel to each other on a force direction so as to provide greater support, buffer effect and comfort.

Specifically, the first and second recoverable layers 10, 20 may have different physical characteristics (for example, hardness) to provide different extent of support, and the first and second recoverable layers 10, 20 each have a stereoscopic mesh fabric configuration to provide greater support and air permeability.

In this embodiment, the outer layer 40 is air-impermeable, for example, a film layer of PU or a film layer on a cloth for covering PU so that air flow can flow in the circulation flow passageway 50 on a single direction to prevent heat accumulation and to adjust temperature.

In addition, the outer layer 40 is air-permeable such as a cloth layer (for example, mutispandex or canvas) or a water-proof ventilating film layer, the outer layer 40 has a plurality of pores 41 communicating with outside (as shown in FIG. 3), and through air diffusing from inside to outside to exclude dirt and humidity accumulated in the cushion 1, the cushion 1 does not accumulate heat and odor easily and has preferable air permeability and air circulation.

The circulation flow passageway 50 has an inlet end 51 and an outlet end 52, in this embodiment, the outlet end 52 has at least one venting hole 521, and there may be a plurality of the at least one venting holes 521. In this embodiment, a number of the at least one venting hole 521 is one so as to vent out air in the circulation flow passageway 50 to maintain a preferable air circulation effect. Preferably, a total cross-sectional area of the plurality of pores is smaller than a cross-sectional area of the at least one venting hole 521, for air to circulate on a single direction. In other embodiments, the inlet end 51 and the outlet end 52 may further include a check valve so that air can enter and exit through the inlet end 51 and outlet end 52 of the cushion 1 on the single direction.

The separation layer 30 is air-permeable such as a cloth layer or a film layer, the separation layer 30 has a plurality of pores communicating with the first and second recoverable layers 10, 20 (because each said pore is in a minimal dimension, each said pore is not shown), a part of air can pass each said pore to balance pressures of the first and second recoverable layers 10, 20. Preferably, a total cross-sectional area of the plurality of pores is smaller than a cross-sectional area of the passage 31 so as to provide air circulation effect on the single direction. The separation layer 30 may be air-impermeable so that air may circulate more preferably on the single direction.

Figure 4:
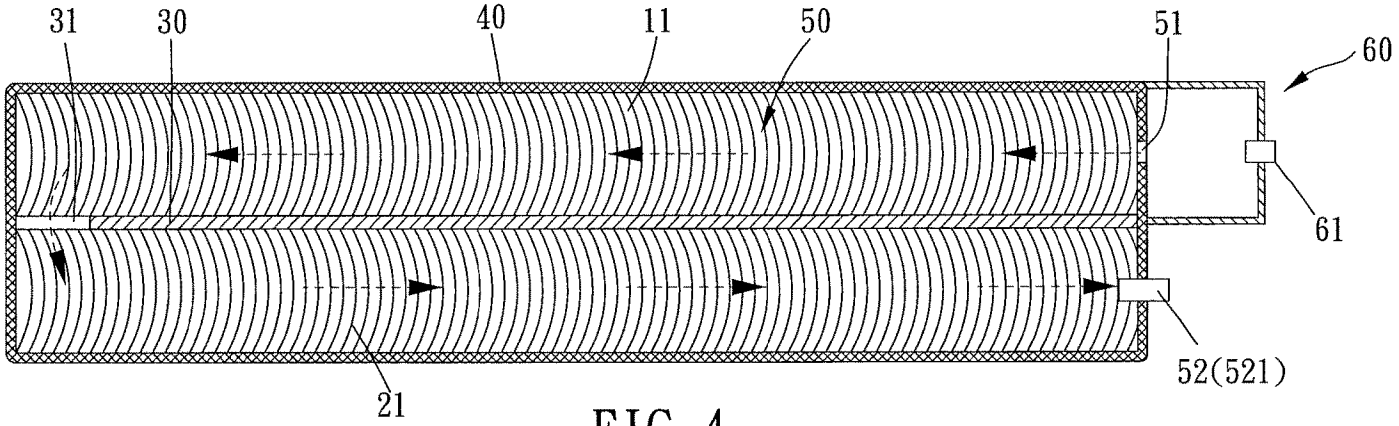
FIG. 4 is a cross-sectional view of a second preferred embodiment of the present invention.

In this embodiment, air can enter in a passive way (for example, a suction force produced when the cushion 1 which is pressed recovers), through the first flow passageway 11, the passage 31, the second flow passageway 21 and out from the outlet end 52 so that air forms a single-direction circulation in the cushion 1. Please refer to FIG. 4 for a second preferred embodiment of the present invention, compared with the first preferred embodiment, the cushion 1 further includes an inflation device 60, the inflation device 60 may be, for example, a pump, and the inflation device 60 has an inflation hole 61 which communicates with the inlet end 51; through guiding in air actively, a constant inflation pressure drives air circulation, and air diffuses from inside to outside to exclude dirt and humidity accumulated in the cushion 1 and to prevent heat accumulation.

Figure 5:
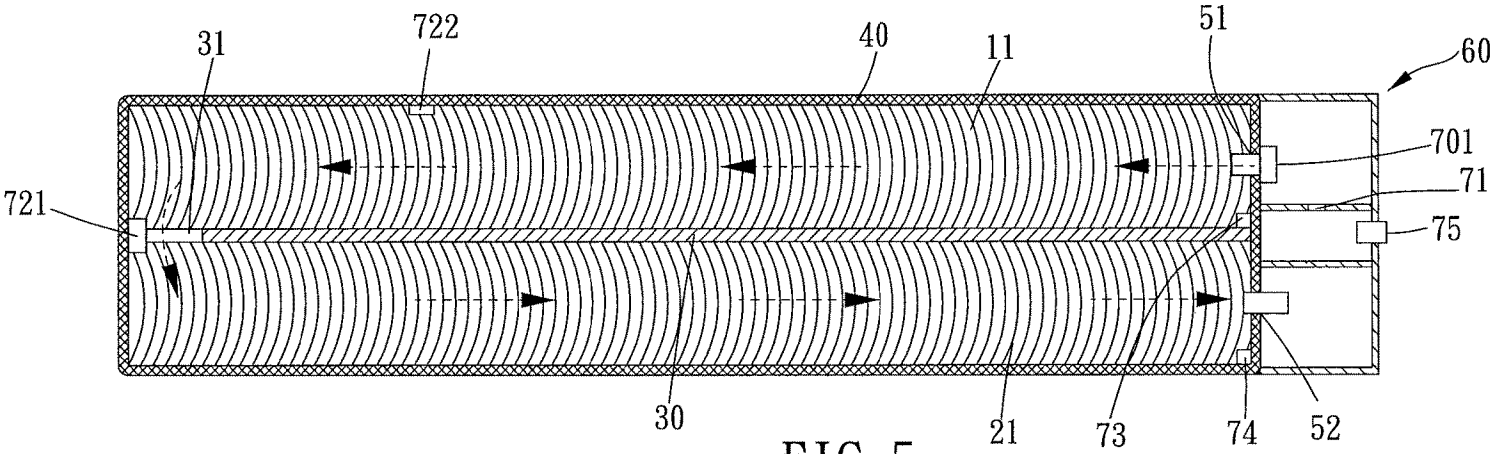
FIG. 5 is a cross-sectional view of a third preferred embodiment of the present invention.
Figure 6:
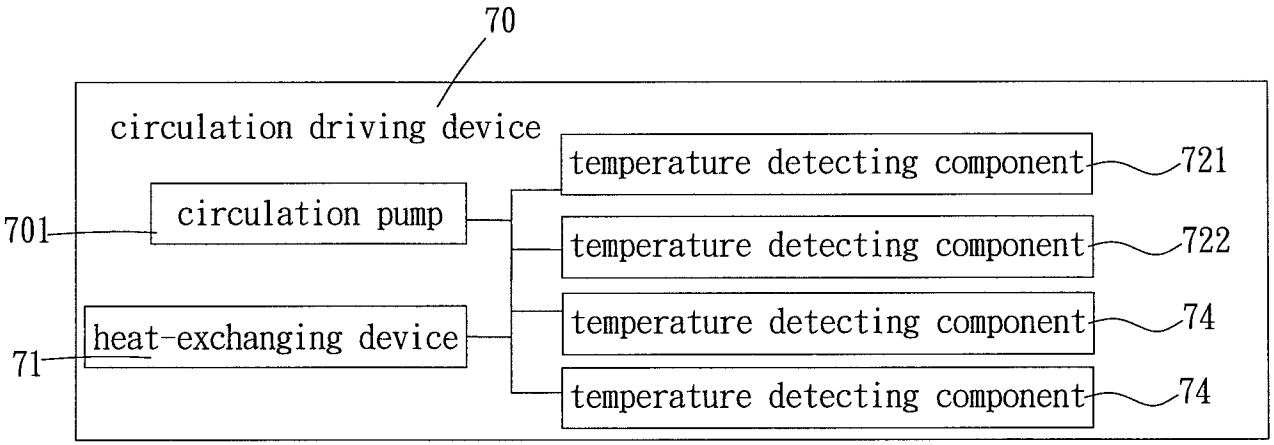
FIG. 6 is a block diagram of a circulation driving device of the third preferred embodiment of the present invention.

Please refer to FIGS. 5 and 6 for a third preferred embodiment of the present invention, compared with the second preferred embodiment, the cushion 1 further includes a circulation driving device 70, the circulation driving device 70 communicates with the inlet end 51 and the outlet end 52, the circulation driving device 70 further includes a circulation pump 701, a heat-exchanging device 71, and a plurality of temperature detecting components 721, 722, 73, 74, and a number and arrangement positions of the plurality of temperature detecting components 721, 722, 73, 74 are not limited; in this embodiment, the plurality of temperature detecting components 721, 722, 73, 74 are disposed on at least one of the outer layer 40, the passage 31, the inlet end 51 and the outlet end 52, specifically, the plurality of temperature detecting components 721, 722, 73, 74 are respectively disposed on the passage 31, the outer layer 40, the inlet end 51, the outlet end 52, the heat-exchanging device 701 is electrically connected to the plurality of temperature detecting components 721, 722, 73, when the circulation pump 701 detects there are temperature differences between the plurality of detecting components 721, 73 or between the plurality of detecting components 722, 73, the circulation pump 701 is activated to accelerate air circulation to balance the temperature of the whole cushion within a preset range; the heat-exchanging device 71 is electrically connected to each said temperature detecting component 73, 74; when the circulation pump 701 detects that a temperature difference between two of the detecting components 73, 74 is greater than a preset limit of temperature difference, the heat-exchanging device 71 is activated to balance the temperature within the preset range. Specifically, the heat-exchanging device 71 has an inflation hole 75, through the inflation hole 75, a pressure loss caused by air escaping from a surface of the cushion may be compensated, and the user can optionally inflate cold or hot air to maintain the temperature of the cushion 1.

While we have shown and described various embodiments in accordance with the present invention, it should be clear to those skilled in the art that further embodiments may be made without departing from the scope of the present invention.

What is claimed is:

1. A cushion, including:

a first recoverable layer, having a first flow passageway;

a second recoverable layer, having a second flow passageway;

a separation layer, located between the first and second recoverable layers, one of two ends of the separation layer having a passage, the first flow passageway, the passage and the second flow passageway forming a circulation flow passageway, the first and second recoverable layers being connected with the separation layer;

an outer layer, encompassing and being connected with the first recoverable layer, the second recoverable layer and a side portion of the separation layer.

2. The cushion of claim 1, wherein the outer layer is air-impermeable.

3. The cushion of claim 1, wherein a thickness of the second recoverable layer is between 1.00 cm and 50.00 cm.

4. The cushion of claim 1, wherein a thickness of the first recoverable layer is between 1.00 cm and 20.00 cm.

5. The cushion of claim 1, wherein the separation layer is air-impermeable.

6. The cushion of claim 1, wherein the separation layer is air-permeable, the separation layer has a plurality of pores communicating with the first and second recoverable layers, and a total of the plurality of pores of the separation layer is smaller than a cross-sectional area of the passage.

7. The cushion of claim 1, wherein the circulation flow passageway has an inlet end and an outlet end, and the outlet end has at least one venting hole.

8. The cushion of claim 7, further including an inflation device, the inflation device having an inflation hole which communicates with the inlet end.

9. The cushion of claim 7, further including a circulation driving device, the circulation driving device communicating with the inlet end and the outlet end, the circulation driving device further including a circulation pump, a heat-exchanging device, a plurality of temperature detecting components, the plurality of temperature detecting components being disposed on at least one of the outer layer, the passage, the inlet end and the outlet end, the heat-exchanging device being electrically connected to each said temperature detecting component, the heat-exchanging device having an inflation hole, the circulation pump being electrically connected to at least two of the temperature detecting components.

10. The cushion of claim 7, wherein the outer layer is air-permeable, the outer layer has a plurality of pores communicating with outside, and a total cross-sectional area of the plurality of pores is smaller than a cross-sectional area of the at least one venting hole.

11. The cushion of claim 10, further including an inflation device, the inflation device having an inflation hole which communicates with the inlet end.

12. The cushion of claim 10, further including a circulation driving device, the circulation driving device communicating with the inlet end and the outlet end, the circulation driving device further including a circulation pump, a heat-exchanging device, a plurality of temperature detecting components, the plurality of temperature detecting components being disposed on at least one of the outer layer, the passage, the inlet end and the outlet end, the heat-exchanging device being electrically connected to each said temperature detecting component, the heat-exchanging device having an inflation hole, the circulation pump being electrically connected to at least two of the temperature detecting components.

13. The cushion of claim 10, wherein the first and second recoverable layers each have a stereoscopic mesh fabric configuration; the outer layer is a cloth layer or a water-proof ventilating film layer; the separation layer is a cloth layer or a film layer, the separation layer has a plurality of pores communicating with the first and second recoverable layers, and a total cross-sectional area of the plurality of pores of the separation layer is smaller than a cross-sectional area of the passage; the separation layer is made of a soft material; a thickness of the first recoverable layer is between 1.00 cm and 20.00 cm; and a thickness of the second recoverable layer is between 1.00 cm and 50.00 cm.

14. The cushion of claim 13, further including an inflation device, the inflation device having an inflation hole which communicates with the inlet end.

15. The cushion of claim 13, further including a circulation driving device, the circulation driving device communicating with the inlet end and the outlet end, the circulation driving device further including a circulation pump, a heat-exchanging device, a plurality of temperature detecting components, the plurality of temperature detecting components being disposed on at least one of the outer layer, the passage, the inlet end and the outlet end, the heat-exchanging device being electrically connected to each said temperature detecting component, the heat-exchanging device having an inflation hole, the circulation pump being electrically connected to at least two of the temperature detecting components.

* * * * *